United States Patent [19]

Ballinger

[11] 4,297,074

[45] Oct. 27, 1981

[54] DEMOUNTABLE INTERCONNECTION

[76] Inventor: Paul V. Ballinger, 7630 Westwood, Findlay, Ohio 45840

[21] Appl. No.: 110,238

[22] Filed: Jan. 7, 1980

[51] Int. Cl.[3] ..... E02F 3/81

[52] U.S. Cl. ..... 414/723; 37/117.5; 403/321

[58] Field of Search ..... 414/723, 724, 686; 37/117.5; 172/272-275; 403/322, 321, 316

[56] References Cited

U.S. PATENT DOCUMENTS

| | | | |
|---|---|---|---|
| 2,447,150 | 8/1948 | Andersen | 37/117.5 |
| 3,389,819 | 6/1968 | Schumacher | 414/723 |
| 3,606,052 | 9/1971 | Schurz | 414/723 |
| 3,794,195 | 2/1974 | Clevenger | 414/723 |
| 3,934,738 | 1/1976 | Arnold | 414/723 |
| 3,964,622 | 6/1976 | Blair et al. | 414/723 |
| 3,985,249 | 10/1976 | Aker et al. | 414/723 |
| 4,068,959 | 1/1978 | Pemberton | 172/273 |
| 4,106,645 | 8/1978 | Janish | 414/723 |
| 4,187,050 | 2/1980 | Barbee | 414/723 |
| 4,214,840 | 7/1980 | Beales | 414/723 X |

*Primary Examiner*—Trygve M. Blix
*Assistant Examiner*—Terrance L. Siemens
*Attorney, Agent, or Firm*—Wilson, Fraser, Barker & Clemens

[57] ABSTRACT

A demountable interconnection for use with material handling and excavating equipment includes a dual hook carriage which may be semi-permanently attached to the boom or dipperstick of a material handler and suitable structures such as parallel beams disposed in the material handling attachment which may be selectively engaged by the dual hook carriage. A locking clevis is movable between a first position and a second position to lock or release the carriage from the attachment.

15 Claims, 10 Drawing Figures

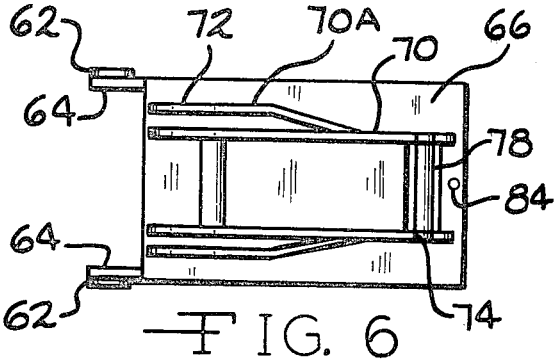
FIG. 6
FIG. 7
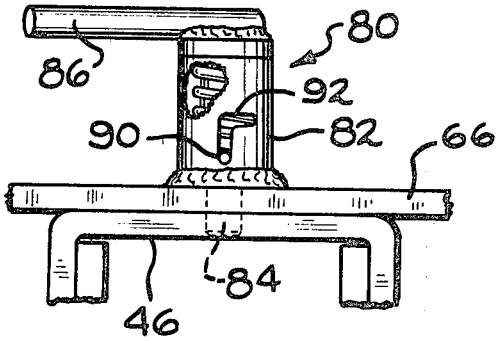
FIG. 9
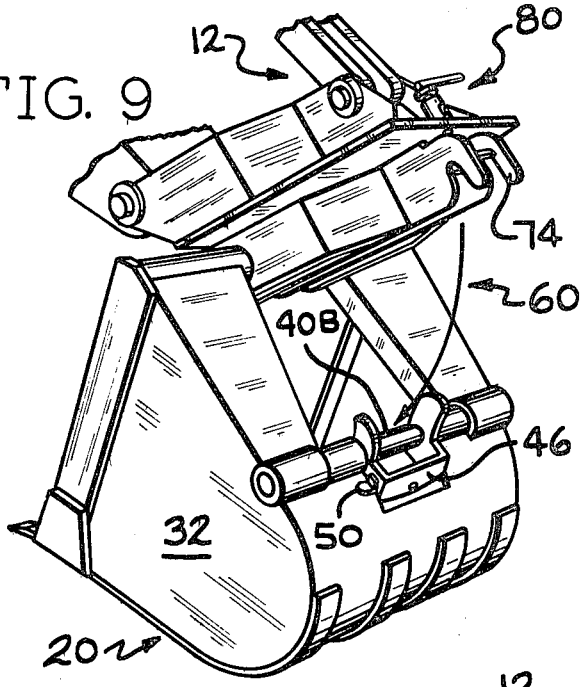
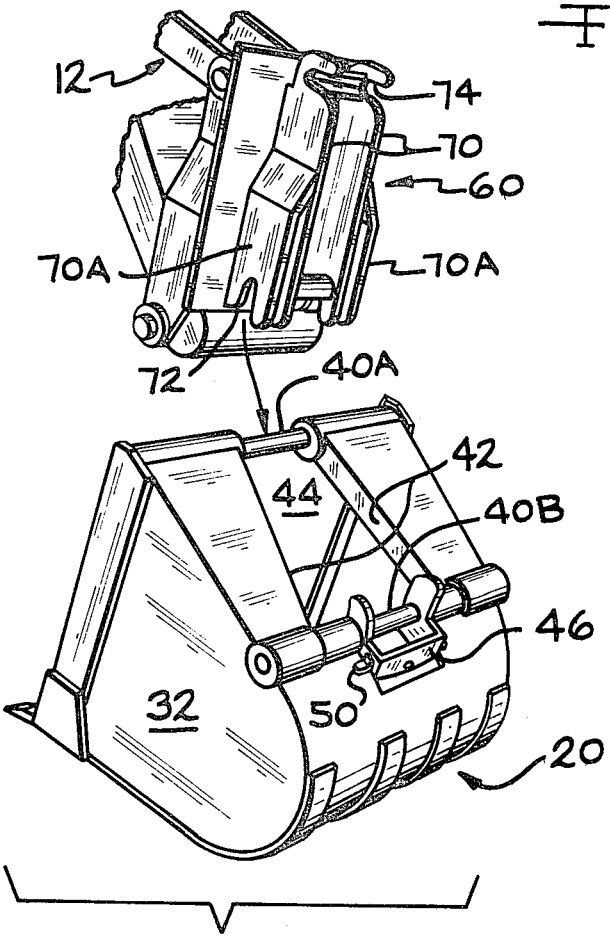
FIG. 8
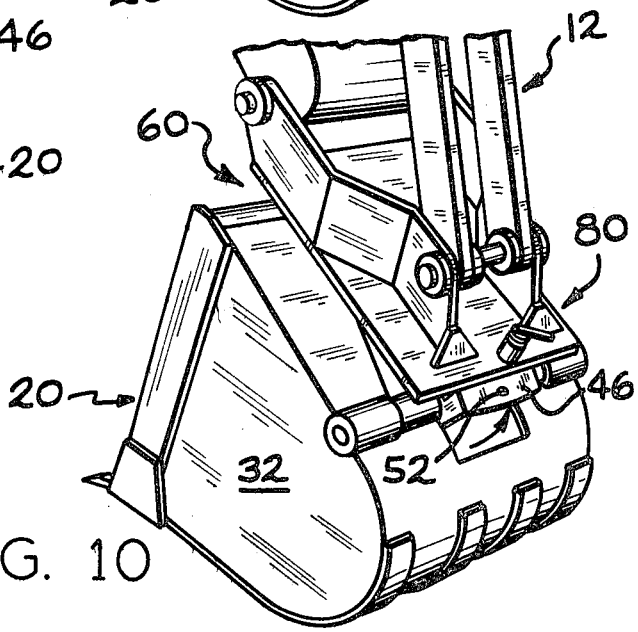
FIG. 10

DEMOUNTABLE INTERCONNECTION

BACKGROUND OF THE INVENTION

The invention relates generally to devices for quickly effecting connection and disconnection of mechanical components and more specifically to such devices for interconnecting various implements such as buckets, blades and rippers to equipment such as trenchers and loaders.

Material handling equipment such as hydraulic loaders, back hoes and trenchers have become the work horses of the bulk material handling, excavating and construction industries. They are perhaps most popular in the construction industry. A singular reason for this popularity is the flexibility of the equipment which encourages and enables its use for a variety of tasks such as digging, trenching, concrete removal, back filling and grading.

Intimately related to this flexibility is the ease with which various implements designed to perform these varigated tasks may be connected and disconnected from the boom or dipperstick of the equipment. Ideally, the boom or dipperstick and implements will include complementary connection means which expedite release and reconnection of various implements as they are needed during the course of work. Since the equipment is not performing useful work during the implement exchange procedure, it is desirable to utilize an interconnecting means which is structurally simple, rapidly operable, and basically foolproof. Conversely, if such release and reconnection are difficult, the likelihood that one implement will be used for a purpose for which it may not be well suited, thereby extending the time required to perform a project as well as possibly damaging the equipment through improper use, is increased.

Commonly such interconnection comprises a plurality of bushings disposed on the boom and implement which may be aligned and through which retaining pins may be driven. Such configurations, though extremely simple, exhibit shortcomings. Since the bushings must be accurately aligned before the pins may be inserted, boom positioning is critical and generally requires either that an assistant stationed on the ground direct the machine operator or that the machine operator repeatedly dismount the machine, inspect the theoretically improving angular alignment, remount and further adjust the position of the boom. Such procedures are obviously both time consuming and costly.

Several interconnecting configurations intended to alleviate these difficulties have recently been suggested. U.S. Pat. Nos. 3,389,819; 3,874,533, and 3,985,249 disclose devices which assist the exchange and connection of buckets and the like to loader and trencher booms. Unfortunately, these designs generally include interengaging members which cannot be fitted to or upon many bucket configurations or which incorporate latches or mechanisms which may be rendered inoperative when exposed to the rugged working environment and service related abuse to which such equipment is routinely subjected.

SUMMARY OF THE INVENTION

The instant invention comprehends a demountable interconnection which includes a carriage which may be attached to the boom or dipperstick of material handling equipment and parallel spaced-apart beams disposed on the implement which may be engaged by the carriage. The carriage defines two channels or hooks disposed substantially at right angles to one another which engage the parallel spaced-apart implement beams. A clevis, preferably rotatably positioned about one of the parallel beams, is movable from a first, unlocked position to a second, locked position to retain the carriage upon the parallel beams. A manually operated spring-biased locking mechanism selectively retains or releases the locking clevis in its second, locked position.

It is thus the object of the instant invention to provide a demountable interconnection for use between booms and implements of material handling equipment.

It is a further object of the instant invention to provide a demountable interconnection for use with material handling equipment which may be simply and quickly connected and disconnected by the machine operator.

It is a still further object of the instant invention to provide a demountable connection for use with material handling equipment which is simple, rugged and is not subject to fouling by dirt and foreign objects.

It is a still further object of the instant invention to provide a demountable interconnection having a hook structure which secures readily and semi-permanently to a conventional trencher or loader boom.

It is a still further object of the instant invention to provide a demountable interconnection which may be adapted to and utilized with a wide variety of material handling and excavating equipment such as buckets, blades and rippers.

Still further objects and advantages of the instant invention will become apparent by reference to the following specification and attached drawings.

BRIEF DESCRIPTION OF THE DRAWINGS

FIG. 6 is a bottom plan view of a demountable interconnection carriage according to the instant invention;

FIG. 7 is a fragmentary side elevational view of a locking mechanism incorporated in the instant invention;

FIG. 8 is a perspective view of a demountable interconnection carriage according to the instant invention which is about to be engaged to a bucket incorporating cooperating structures;

FIG. 9 is a perspective view of a demountable interconnection carriage according to the instant invention in a semi-engaged position on a bucket incorporating cooperating structures; and FIG. 10 is a perspective view of a demountable interconnection carriage according to the instant invention about to be locked to a bucket incorporating cooperating structures.

DESCRIPTION OF THE PREFERRED EMBODIMENT

Figure 1:
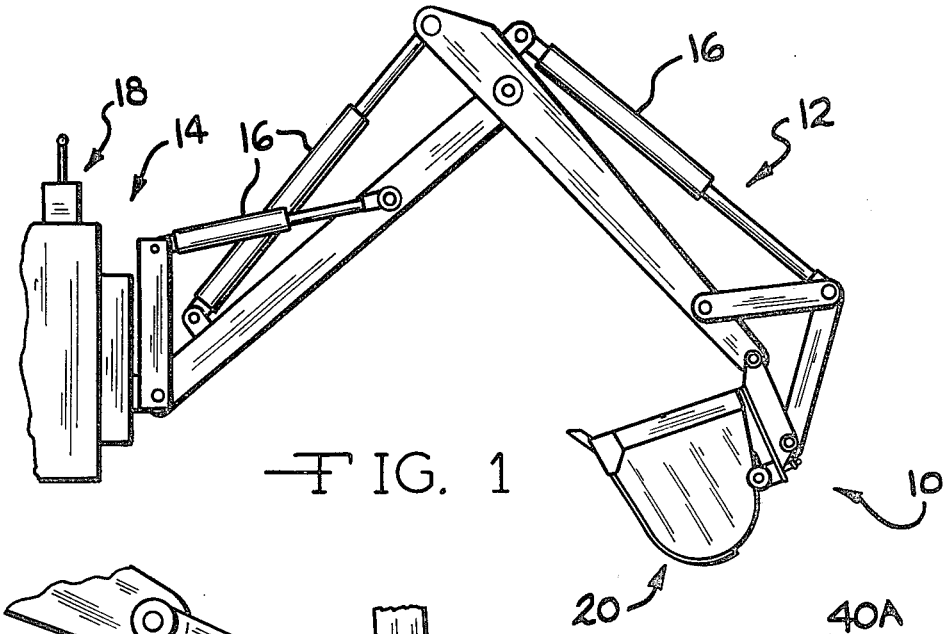
FIG. 1 is a side elevational view of a typical trencher dipperstick having a bucket selectively connected thereto by means of a demountable interconnection according to the instant invention.

Referring now to FIG. 1 a demountable interconnection for implements such as buckets, scoops, blades, or rippers to be used on material handlers such as loaders or trenchers is generally designated by the reference numeral 10. The demountable interconnection 10 is shown in place on the dipperstick or boom 12 of a back hoe or trencher 14. The dipperstick 12 is a conventional multi-pivot design and includes a plurality of hydraulic cylinders 16 which are linked to a plurality of hydraulic controls 18 by suitable hydraulic lines (not illustrated). Cooperation between the various pivoted components of the dipperstick 12 and hydraulic cylinders 16 enables movement about a vertical axis adjacent the trencher 14 and about horizontal axes at the various pivot points illustrated and provides motional freedom and directional control. Inasmuch as the instant invention is directed primarily to the demountable interconnection 10, it should be understood that the particular arm or boom device with which it is used is not significant. Rather, it should be appreciated that the interconnection is broadly applicable and adaptable to material handling equipment in general. Secured to the dipperstick 12 by means of the demountable interconnection 10 is a bucket 20. The bucket 20 includes cooperating structures which constitute a portion of the demountable interconnection 10. For reasons of clarity and simplicity, the instant invention is illustrated and will be described in connection with a bucket 20, although it should be understood that a bucket is but one of numerous implements with which the interconnection 10 may be readily used.

Figure 2:
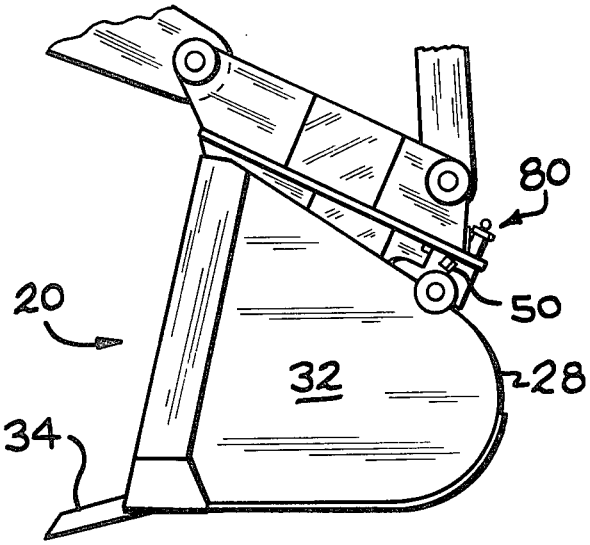
FIG. 2 is a side elevational view of a bucket and demountable interconnection according to the instant invention.
Figure 3:
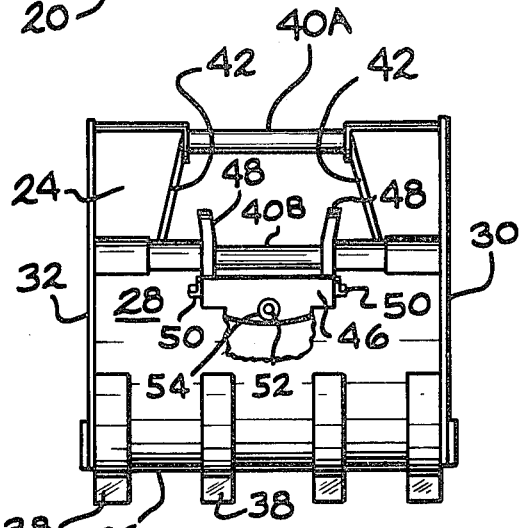
FIG. 3 is an end elevational view of a bucket incorporating structures which form a portion of a demountable interconnection according to the instant invention.
Figure 4:
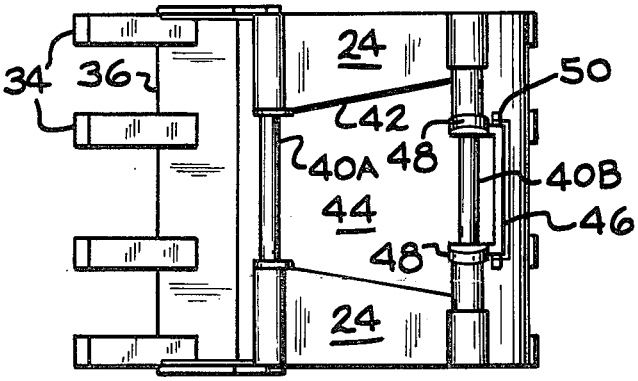
FIG. 4 is a top plan view of a bucket incorporating structures which form a portion of a demountable connection according to the instant invention.

Referring now to FIGS. 2, 3, and 4, the bucket 20 is of substantially conventional design and includes a generally planar top panel 24 and a bottom panel 26 joined by a curved portion or panel 28. The three panels 24, 26, and 28 may, of course, be fabricated of a unitary metal plate which has been appropriately formed. The bucket 20 further includes left and right side panels 30 and 32, respectively, which close off respective edges of the bucket 20. The bucket 20 is preferably assembled by welding along the lines of intersection of the various panels just described. The bucket 20 preferably includes a plurality of teeth 34 disposed along a lower leading edge 36 of the bottom panel 26. Reinforcing runners or skids 38 may be secured to the outer surface of the bottom panel 26 and curved panel 28 to improve the rigidity of the bucket 20 as well as to lessen friction and wear of the bottom panel 26.

Disposed transversely across the top of the bucket 20, generally in the plane of the top panel 24, are a front beam 40A and a rear beam 40B. The beams 40A and 40B are preferably circular in cross section but may, of course, define other cross sections compatible with the demountable interconnection 10. The top panel 24 defines a pair of opposed, non-parallel inner edges 42. The beams 40A and 40B and the inner edges 42 of the top panel 24 define a generally trapezoidal opening 44 which tapers toward the front of the bucket 20. The function and advantages of the trapezoidal opening 44 will be described in greater detail in the section dealing with the operation of the demountable interconnection 10. Freely rotatably disposed on the rear beam 40B is a locking clevis 46. The clevis 46 is generally U-shaped and defines at least two aligned openings (not illustrated) disposed in its leg positions which rotatably mount the clevis 46. clevis includes a pair of obliquelty disposed ears 48 which are oriented upwardly and outwardly when the clevis 46 is in its released position illustrated in FIGS. 3 and 4. The locking clevis 46 also includes a pair of stop structures 50 which take the form of outwardly extending tabs on the left and right sides of the locking clevis 46. The stop structures 50 interfere with the curved panel 28 of the bucket 20 and prohibit rotation of the locking clevis 46 beyond this point of interference. The locking clevis 46 also defines a pin receiving opening 52. The pin receiving opening 52 may be reinforced by means of a suitable washer or weldment material 54 built up about the opening 52. The function and features of the ears 48, stop structures 50 and pin receiving opening 52 will be fully described in the operation section of this specification.

Figure 5:
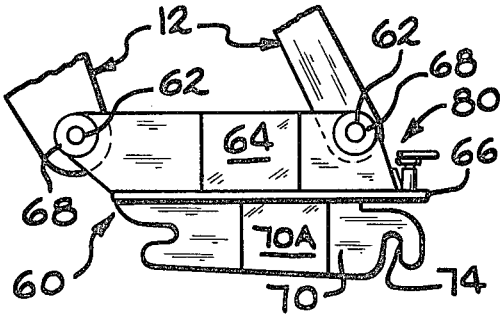
FIG. 5 is a side elevational view of a demountable interconnection carriage according to the instant invention.

Referring now to FIGS. 5 and 6, the demountable interconnection of the instant invention is seen to include a dual hook carriage 60. The carriage 60 is secured to appropriate members of the dipperstick 12 by means of drive pins 62 according to conventional practice. The carriage 60 includes a pair of vertically disposed plates 64 which are secured by welding or other suitable means to a base plate 66 and which also mount a plurality of bushings 68 to which the drive pins 62 are disposed. Secured to the lower portion of the base plate 66 by welding or other suitable means is a plurality of vertically aligned hook plates 70. Two of the hook plates 70 are parallel and extend generally the full length of the base plate 66 whereas an outer pair of the hook plates 70A define a first parallel portion and a second obliquely disposed portion which intersects and is secured to the parallel hook plates 70. All of the hook plates 70 and 70A define an aligned front and rear pair of hooks or slots 72 and 74, respectively. The front plurality of slots 72 opens to the front of the carriage 60 and lie generally along a horizontal axis whereas the rear plurality of slots 74 opens toward the bottom of the carriage 60 and lies generally along a vertical axis. A brace 76 having a generally semi-circular cross section is positioned in the interstice between the plates 70 and secured by suitable means such as welding. The inner semi-circular surface of the brace 76 is aligned with the rear surface of the plurality of front slots 72. In a like manner, a similar brace 78 having a semi-circular cross section is disposed in the interstice between the parallel braces 70 and secured thereto in alignment with the upper surface of the plurality of rear slots 74. The braces 76 and 78 increase the structural integrity of the carriage 60 in general and the plates 70 specifically as well as providing increased bearing surface in contact with the transverse braces 40A and 40B of the bucket 20 or other implement.

Referring now to FIG. 5 and especially to FIG. 7, the carriage 60 includes a locking pin assembly 80. The locking pin assembly 80 is disposed on the upper surface of the base plate 66, adjacent the end more proximate the vertical slot 74 and generally centered between the pair of vertically disposed plates 64 and the plates 70. The locking pin assembly 80 preferably includes a hollow cylindrical housing 82 which may be secured to the base plate 66 of the carriage 60 by welding or other suitable fastening means. The cylindrical housing 82 rotatably mounts a locking pin 84 which is coaxially disposed therein. The locking pin 84 is secured to a radially disposed handle 86. Also disposed within the cylindrical housing 82 and secured to its upper portion is a compression spring 88. The lower portion of the compression spring 88 abuts a radially disposed detent pin 90. The detent pin 90 travels in an L-shaped slot or track 92. The extension of the locking pin 84 beyond the base plate 66 may thus be controlled by lifting and turning the handle 86 to cause the detent pin 90 to drop downwardly in the L-shaped slot 92 or rest on the horizontal surface thereof.

FIGS. 8, 9, and 10 serially illustrate connection of the demountable interconnection 10 and specifically the carriage 60 with the transverse front and rear beams 40A and 40B, respectively, of the bucket 20. Obviously, the Figures taken in their reverse order, namely 10, 9, and 8, illustrate the disconnection of these two components from one another. Referring to FIG. 8, the bucket 20 having the transverse beams 40A and 40B and locking clevis 46 is shown resting on the ground in a generally upright position. The dipperstick 12 of a back hoe or trencher 14 is adjusted by the operator such that the plurality of front slots 72 of the carriage 60 is generally above and parallel to the front beam 40A. The carriage 60 is then lowered and/or brought toward the bucket 20 along an axis defined by the parallel surfaces of the plurality of slots 72 until the front transverse beam 40A is fully seated within the plurality of front slots 72. It should be noted that the trapezoidal opening 44 formed by the inner edges 42 of the top panel 24 directs the carriage 60 and specifically the plates 70A into alignment with the front transverse beam 40A should it be somewhat displaced from the substantially optimum alignment illustrated in FIG. 8.

Referring now to FIG. 9, the plurality of front slots 72 of the carriage 60 is shown fully engaged to the front transverse beam 40A. The dipperstick 12 is then adjusted to lower the rear portion of the carriage 60 and engage the vertically oriented plurality of rear slots 74 with the rear transverse beam 40B. Again, the ears 48 on the locking clevis 46 which have been held in their generally upright position by the stop structures 50 assist alignment and engagement of the plates 70 and specifically the plurality of rear slots 74 with the rear transverse beam 40B.

In FIG. 10, the carriage 60 is fully seated on the bucket 20. That is, the plurality of front slots 72 is fully seated against the front transverse beam 40A and the plurality of rear slots 74 is fully seated against the rear transverse beam 40B. To secure the bucket 20 to the carriage 60, the locking clevis 46 is manually rotated upwardly, as the arrow in FIG. 10 indicates, until the pin receiving opening 52 is aligned with the axis of the locking pin 84 such that it may be inserted thereinto. Rotation of the handle 86 causes the detent pin 90 to move off the horizontal surface of the track 92 and enable movement of the locking pin 84 into the pin receiving opening 52 thereby securing the locking clevis 46 in its upper, locked position.

Disassembly of the demountable interconnection 10 simply follows these steps in the reverse order. That is, the handle 86 of the locking pin assembly 80 is lifted and rotated such that the locking pin 84 recedes from the pin receiving opening 52 in the locking clevis 46. The locking clevis 46 is then rotated in a direction opposite from the arrow in FIG. 10, freeing the rear portion of the carriage 60. The dipperstick 12 of the trencher 14 may then be adjusted to first lift the plurality of rear slots 74 from the rear transverse beam 40B as shown in FIG. 9 and then to disengage the plurality of front slots 72 from the front transverse beam 40A.

As noted previously, although the demountable interconnection 10 has been described and illustrated with reference to a bucket, it should be understood that the transverse beam and dual slot carriage may be utilized with a broad variety of earth moving, material handling and related implements.

The foregoing disclosure is the best mode devised by the inventor for practicing this invention. It is apparent, however, that devices incorporating modifications and variations to the instant invention will be obvious to one skillled in the art of demountable interconnections. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. Apparatus for use with material handling equipment comprising, in combination, a first engageable member for securement to an implement and a second engageable member for securement to said implement, said first and said second members generally defining parallel radially spaced-apart axes, a locking structure rotatably disposed about one of said members and moveable between a first, unlocked position and a second, locked position, and a carriage adapted for securement to a boom of a material handler, said carriage defining at least one first slot for engaging said first member and at least one second slot for engaging said second member, and means for selectively maintaining said locking structure in said second, locked position.

2. The apparatus of claim 1 wherein said first and second engageable members define a pair of substantially parallel beams oriented generally transversely across said implement.

3. The apparatus of claim 1 wherein said implement further includes guide means disposed generally between said first and said second members for guiding said carriage into engagement with said members.

4. The apparatus of claim 3 wherein said guide means includes structures having opposed, obliquely disposed edges extending generally from said first member to said second member.

5. The apparatus of claim 4 wherein said obliquely disposed edges and said first and second members generally define a trapezoidal aperture.

6. The apparatus of claim 1 wherein said locking structure includes a clevis rotatably disposed on one of said support members, said clevis defining means for receiving said means for selectively maintaining said locking structure in said second, locked position and including outwardly extending tab means for guiding said carriage into engagement with said members.

7. A demountable interconnection for use with material handling equipment comprising, in combination, a carriage adapted for securement to a boom of a material handler, said carriage defining at least one first receiving slot and at least one second receiving slot, said first and said second slots defining mouths oriented substantially perpendicularly to one another and including a retaining structure moveable between a first, open position and a second, closed position, a first member engageable by said first slot and a second member engageable by said second slot and spaced from said first member, said first and second members secured to an implement, and means disposed about one of said members for selectively retaining one of said members in one of said slots, said just recited means including means for receiving said retaining structure.

8. A demountable interconnection for use with material handling equipment comprising, in combination, a first engageable member on an implement, a second engageable member on the implement disposed in substantially parallel, spaced apart relationship with said first member, a clevis rotatably disposed about one of said members, said clevis moveable between a first, unlocked position and a second, locked position and including cooperating means for maintaining said clevis in said second, locked position, and an engaging structure securable to a boom of a material handler, said structure defining at least one first slot for receiving said first member and at least one second slot for receiving said second member and means cooperating with said cooperating means for selectively maintaining said clevis in said second, locked position.

9. The demountable interconnection of claim 8 wherein said implement further includes guide means disposed generally between said first and said second members for guiding said engaging structure into engagement with said members.

10. The demountable interconnection of claim 9 wherein said guide means includes structures having opposed, obliquely disposed edges extending generally from said first member to said second member.

11. The demountable interconnection of claim 8 wherein said first and second engageable members define a pair of substantially parallel beams.

12. The demountable interconnection of claim 8 wherein said clevis further includes upwardly diverging tab means for guiding said engaging structure into engagement with said members.

13. Interconnecting apparatus comprising, in combination, a first, engaging structure defining at least one first receiving slot and at least one second receiving slot, said first and said second slots oriented substantially perpendicularly to one another, a second, engageable structure including a pair of parallel radially spaced-apart members receivable within a respective one of said slots, and latch means rotatably disposed about one of said parallel members for restraining said one of said members within said respective one of said slots and means for selectively maintaining said latch means in a position to restrain said one of said members within said respective one of said slots.

14. The apparatus of claim 13 wherein said latch means is a clevis and said first structure defines a clevis receiving slot disposed adjacent one of said receiving slots.

15. The apparatus of claim 13 wherein said latch means defines an aperture and said latch maintaining means includes a pin receivable within said aperture and means for biasing said pin into said aperture.

* * * * *